US009622519B2

(12) United States Patent
Hsiao et al.

(10) Patent No.: US 9,622,519 B2
(45) Date of Patent: Apr. 18, 2017

(54) AIR CIRCLING STRUCTURE AND AIR CONDITIONER WITH THE SAME

(71) Applicant: MOAI ELECTRONICS CORPORATION, Hsinchu (TW)

(72) Inventors: Ching-Chung Hsiao, Hsinchu (TW); Yi-Yang Lin, Hsinchu (TW); Yu-Te Chou, Hsinchu (TW)

(73) Assignee: Moai Electronics Corporation, Hsinchu (TW)

( * ) Notice: Subject to any disclaimer, the term of this patent is extended or adjusted under 35 U.S.C. 154(b) by 125 days.

(21) Appl. No.: 14/800,504

(22) Filed: Jul. 15, 2015

(65) Prior Publication Data

US 2016/0338427 A1 Nov. 24, 2016

(30) Foreign Application Priority Data

May 20, 2015 (TW) ..... 104114823 A

(51) Int. Cl.
*A41D 13/005* (2006.01)

(52) U.S. Cl.
CPC ..... *A41D 13/0053* (2013.01); *F25D 2400/26* (2013.01)

(58) Field of Classification Search
CPC ..... A41D 13/0053; A61F 7/02; A61F 2007/0056; A61F 2007/0018; A61F 2007/009; A61F 2007/0024; A61F 2007/0039; A61F 2007/0225; A61F 2007/0234; A61F 2007/029; A61F 2007/0058
USPC ..... 62/259.2
See application file for complete search history.

(56) References Cited

U.S. PATENT DOCUMENTS 4,869,250 A * 9/1989 Bitterly ..... A41D 13/0053 607/107
5,062,424 A * 11/1991 Hooker ..... A41D 13/0053 128/897
5,086,771 A * 2/1992 Molloy ..... A61F 7/10 128/892
RE36,808 E * 8/2000 Caldwell ..... A41D 13/0053 165/46
2005/0246826 A1* 11/2005 McCarter ..... A41D 13/0053 2/458

(Continued)

*Primary Examiner* — Mohammad M Ali
(74) *Attorney, Agent, or Firm* — Muncy, Geissler, Olds & Lowe, P.C.

(57) ABSTRACT

An air circulating structure includes a housing having first, second and third sidewalls. The second and third sidewalls are positioned in a receiving space defined by the first sidewall and the second sidewall is positioned between the first and third sidewalls. The first sidewall has an opening and bending portions are formed at ends of the first sidewall and bending inward. Further, guiding elements are disposed on sides of the second sidewall facing the receiving space and positioned between the third sidewall and the bending portions. As such, air ducts are formed between the second sidewall and the first sidewall, the third sidewall, the guiding elements, the bending portions, respectively, and air vents are formed in junctions of the guiding elements with the bending portions and the third sidewall, thereby forming circulating air in the air ducts and vents to effectively improve the temperature regulating efficiency of an air-conditioning device.

15 Claims, 5 Drawing Sheets

(56) References Cited

U.S. PATENT DOCUMENTS

| | | | | |
|---|---|---|---|---|
| 2008/0066484 | A1* | 3/2008 | Blackstone | A41D 13/0053 62/421 |
| 2010/0236267 | A1* | 9/2010 | Korytnikov | F24F 5/0035 62/259.3 |
| 2016/0045755 | A1* | 2/2016 | Chun | A61F 7/10 607/102 |

* cited by examiner

AIR CIRCLING STRUCTURE AND AIR CONDITIONER WITH THE SAME

BACKGROUND OF THE INAIR VENTION

1. Field of the Invention

The present invention relates to air-conditioning devices, and more particularly, to a wearable air-conditioning device.

2. Description of Related Art

Along with the rapid development of science and technology, home appliances are developed toward the trend of miniaturization. For example, some traditional air-conditioning devices are installed in inner spaces of dwelling houses. Nowadays, some air-conditioning devices are applicable to wearable devices such as helmets. When a person cycles in hot weather, such a helmet can provide cooling air to make the person feel comfortable.

However, such a wearable air-conditioning device has some drawbacks. Firstly, limited by the structure of the helmet, the cooling air can only flow to a relatively limited location instead of being uniformly discharged in a wide range of area, thus adversely affecting the cooling effect. Secondly, to keep the cooling air at a certain temperature, the cooling mechanism of the air-conditioning device must operate continuously with a certain load, thereby increasing the power consumption and possibly causing overheat of the device. Thirdly, continuous discharging of the cooling air at the same location may cause the user to feel uncomfortable. In addition, if the air-conditioning device bonded with the helmet is applied in an open space, since the cooling air easily dissipates, it is difficult to achieve a desired cooling effect. Also, improving the air-conditioning device bonded with the helmet may reduce the protecting effect of the helmet.

Therefore, there is a need to provide a separate wearable air-conditioning device that is applicable in an open space and not limited by the structure of a helmet.

SUMMARY OF THE INAIR VENTION

In view of the above-described drawbacks, the present invention provides an air circulating structure comprising a housing and a plurality of guiding elements. The housing has a first sidewall constituting a peripheral portion of the housing and defining a receiving space and a second sidewall and a third sidewall positioned in the receiving space with the second sidewall positioned between the first sidewall and the third sidewall. At least an opening is formed in the first sidewall and bending portions are formed at two ends of the first sidewall relative to the opening and bending inward. The guiding elements are disposed on sides of the second sidewall facing the receiving space and positioned between the third sidewall and the bending portions. As such, a plurality of first air ducts are formed between the first sidewall and the second sidewall, a plurality of second air ducts are formed between the second sidewall and the guiding elements, between the second sidewall and portions of the bending portions and between the second sidewall and the third sidewall and communicate with the first air ducts, a plurality of first air vents are formed at junctions of the bending portions and the guiding elements, and a plurality of second air vents are formed at junctions of the guiding elements and the third sidewall.

In an embodiment, ends of the second sidewall extend into areas enclosed by the bending portions but do not contact the bending portions.

In an embodiment, the above-described structure further comprises a heat insulating layer that at least partially encloses the housing.

In an embodiment, the heat insulating layer and the first sidewall are integrally formed.

In an embodiment, the above-described structure further comprises a cover that at least partially encloses the housing and the heat insulating layer.

The present invention further provides an air-conditioning device, which comprises the above-described circulating structure, a first fan and a cooling chip. The circulating structure comprises a housing and a plurality of guiding elements. The housing has a first sidewall constituting a peripheral portion of the housing and defining a receiving space and a second sidewall and a third sidewall positioned in the receiving space with the second sidewall positioned between the first sidewall and the third sidewall. At least an opening is formed in the first sidewall and bending portions are formed at two ends of the first sidewall relative to the opening and bending inward. Further, a first opening is formed in the first sidewall and a second opening corresponding to the first opening is formed in the second sidewall. The guiding elements are disposed on sides of the second sidewall facing the receiving space and positioned between the third sidewall and the bending portions. As such, a plurality of first air ducts are formed between the first sidewall and the second sidewall, a plurality of second air ducts are formed between the second sidewall and the guiding elements, between the second sidewall and portions of the bending portions and between the second sidewall and the third sidewall and communicate with the first air ducts, a plurality of first air vents are formed at junctions of the bending portions and the guiding elements, and a plurality of second air vents are formed at junctions of the guiding elements and the third sidewall. The first fan is disposed in the second opening of the second sidewall. The cooling chip is disposed in the first opening of the first sidewall.

In an embodiment, the above-described device further comprises a first aluminum sheet having opposite first and second side surfaces, wherein the cooling chip has a first surface facing the first fan and a second surface opposite to the first surface, the first side surface of the first aluminum sheet contacting the first surface of the cooling chip and the second side surface of the first aluminum sheet facing the first fan.

In an embodiment, the above-described device further comprises a second aluminum sheet having a first side surface contacting the second surface of the cooling chip and a second side surface opposite to the first side surface.

In an embodiment, the above-described device further comprises a heat insulating layer that at least partially encloses the housing.

In an embodiment, the heat insulating layer and the first sidewall are integrally formed.

In an embodiment, the above-described device further comprises a second fan disposed on the second side surface of the second aluminum sheet.

In an embodiment, the above-described device further comprises a cover. The cover comprises: a first cover portion at least partially enclosing the housing and the heat insulating layer, and a second cover portion at least partially enclosing the second aluminum sheet and the second fan, wherein the second cover portion has a plurality of through holes.

In an embodiment, the above-described device further comprises a power module disposed on the cover for providing power to the cooling chip, the first fan and the second fan.

In an embodiment, the power module comprises an operation interface unit for controlling operation of the cooling chip, the first fan and the second fan.

In an embodiment, the above-described device further comprises a pivot disposed on the cover for pivotally connecting the cover and the power module.

Through the air circulating structure of the present invention, cooling air circulates in an open space so as to reduce temperature in a wide range of area, improve the cooling efficiency and reduce power consumption. Further, the air circulating structure of the present invention is applicable in heating air circulation in winter. Therefore, an air-conditioning device based on the air circulating structure of the present invention is separately wearable for the user instead of being attached to other devices and used as an additional device as in the prior art. Further, the air-conditioning device can be operated by the user anytime and anywhere.

DETAILED DESCRIPTION OF PREFERRED EMBODIMENTS

The following illustrative embodiments are provided to illustrate the disclosure of the present invention, these and other advantages and effects can be apparent to those in the art after reading this specification.

It should be noted that all the drawings are not intended to limit the present invention. Various modifications and variations can be made without departing from the spirit of the present invention. Further, terms such as "upper", "inner", "outer", "bottom", "a" etc. are merely for illustrative purposes and should not be construed to limit the scope of the present invention.

Figure 1:
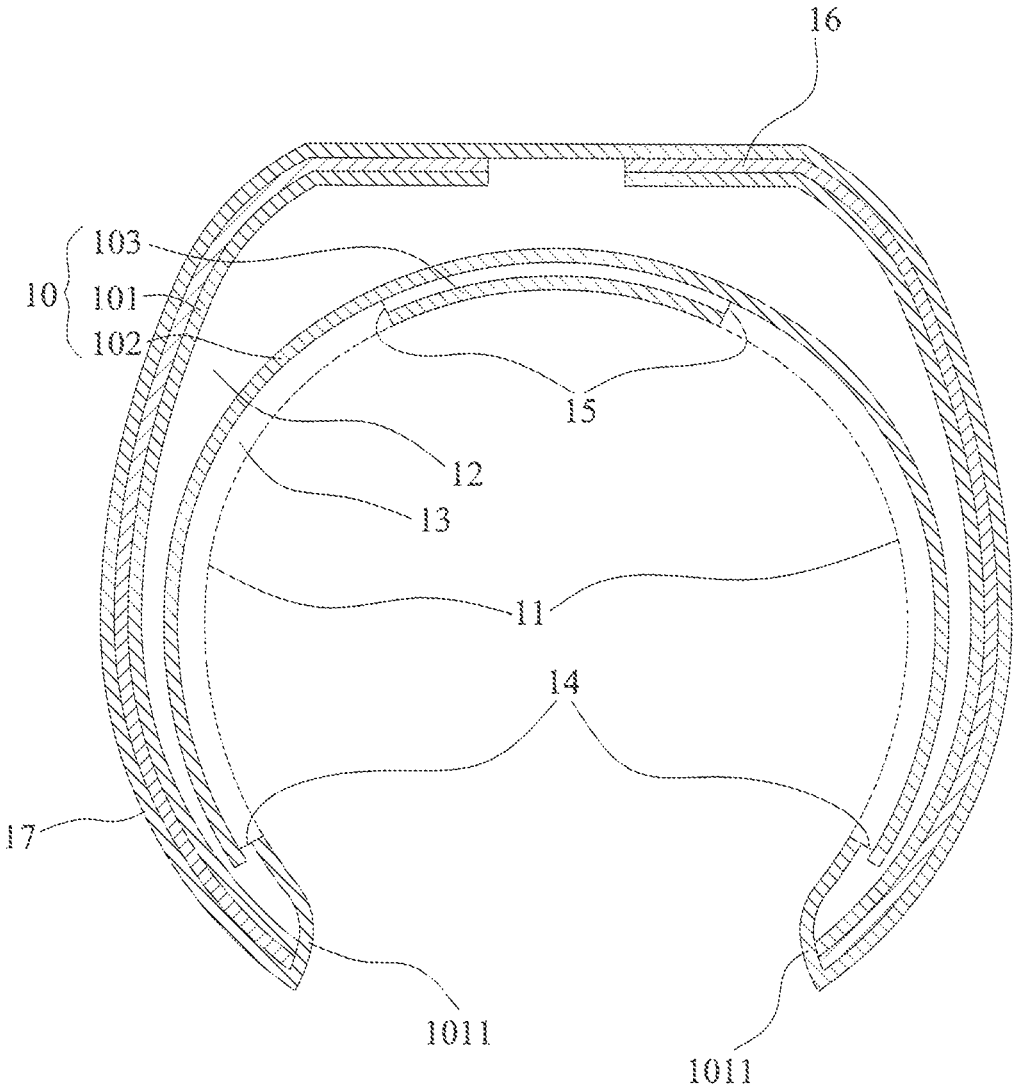
FIG. 1 is a schematic cross-sectional view of an air circulating structure of the present invention.

FIG. 1 is a schematic cross-sectional view of an air circulating structure of the present invention. Referring to FIG. 1, the air circulating structure has a housing 10 and a plurality of guiding elements 11. The housing 10 has a first sidewall 101, a second sidewall 102 and a third sidewall 103. The first sidewall 101 constitutes a peripheral portion of the housing 10 and defines a receiving space. Further, at least an opening is formed in the first sidewall 101 and bending portions 1011 are formed at two ends of the first sidewall 101 relative to the opening and bending inward (i.e., bending toward the receiving space). The second sidewall 102 and the third sidewall 103 are positioned in the receiving space defined by the first sidewall 101, and the second sidewall 102 is positioned between the first sidewall 101 and the third sidewall 103. Further, the first sidewall 101, the second sidewall 102 and the third sidewall 103 are separated from one another by gaps. The guiding elements 11 are disposed on sides of the second sidewall 102 facing the receiving space and positioned between the third sidewall 103 and the bending portions 1011. In particular, each of the guiding elements 11 has one end connected to a corresponding one of the bending portions 1011 and the other end connected to the third sidewall 103. The guiding elements 11 can be, but not limited to, a plurality of fins disposed on the second sidewall 102.

Further referring to FIG. 1, a plurality of first air ducts 12 are formed between the first sidewall 101 and the second sidewall 102. A plurality of second air ducts 13 are formed between the second sidewall 102 and the guiding elements 11, between the second sidewall 102 and portions of the bending portions 1011 and between the second sidewall 102 and the third sidewall 103 and communicate with the first air ducts 12. A plurality of first air vents 14 are formed at junctions of the bending portions 1011 and the guiding elements 11, and a plurality of second air vents 15 are formed at junctions of the guiding elements 11 and the third sidewall 103. In the present embodiment, ends of the second sidewall 102 extend into areas enclosed by the bending portions 1011 but do not contact the bending portions 1011.

In an embodiment, the air circulating structure of the present invention further has a heat insulating layer 16 formed on an outer side of the housing 10 so as to at least partially enclose the first sidewall 101. The heat insulating layer 16 can be made of a material having light weight and high heat insulating efficiency, for example, PE foam. As such, the heating insulating layer 16 prevents the air circulating structure from being adversely affected by ambient temperature. Further, similar to the housing, the heat insulating layer 16 can be made of a soft material so as to facilitate adjustment of the air circulating structure when it is worn around the neck of the user. In an embodiment, the heat insulating layer 16 and the first sidewall 101 are integrally formed. That is, both the heat insulating layer 16 and the first sidewall 101 constitute a portion of the housing 10.

In an embodiment, the air circulating structure further has a cover 17. The cover 17 at least partially encloses the housing 10 and the heat insulating layer 16 so as to protect the air circulating structure from being damaged by collision.

Figure 2:
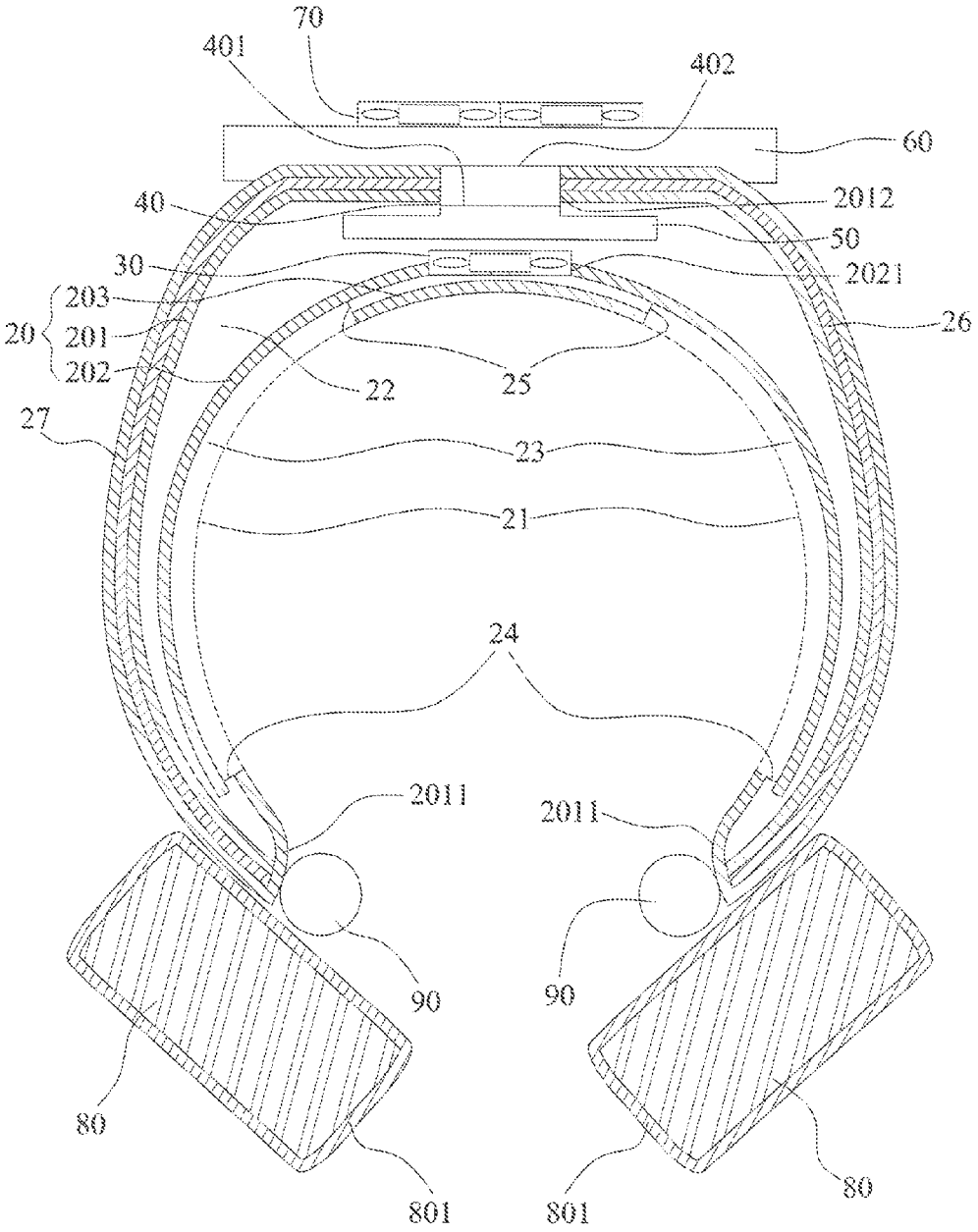
FIG. 2 is a schematic cross-sectional view of an air-conditioning device of the present invention.

FIG. 2 is a schematic cross-sectional view of an air-conditioning device of the present invention. Referring to FIG. 2, the air-conditioning device of the present invention has an air circulating structure, a first fan 30 and a cooling chip 40. As described above, the air circulating structure has a housing 20 and a plurality of guiding element 21. The housing 20 has a first sidewall 201, a second sidewall 202 and a third sidewall 203. The first sidewall 201 constitutes a peripheral portion of the housing 20 and defines a receiving space. Further, at least an opening is formed in the first sidewall 201 and bending portions 2011 are formed at two ends of the first sidewall 201 relative to the opening. The second sidewall 202 and the third sidewall 203 are positioned in the receiving space defined by the first sidewall 201, and the second sidewall 202 is positioned between the first sidewall 201 and the third sidewall 203. The guiding elements 21 are disposed on the second sidewall 202, and each of the guiding elements 21 has one end connected to a corresponding one of the bending portions 2011 and the other end connected to the third sidewall 203. The guiding elements 21 can be, but not limited to, a plurality of fins disposed on the second sidewall 202. The air-conditioning device can be worn by the user around the neck.

Further referring to FIG. 2, a first opening 2012 is formed in the first sidewall 201, and a second opening 2021 is formed in the second sidewall 202 and corresponds to the first opening 2012. The first fan 30 is disposed in the second opening 2021 of the second sidewall 202 and the cooling chip 40 is disposed in the first opening 2012 of the first sidewall 201. A plurality of first air ducts 22 are formed between the first sidewall 201 and the second sidewall 202. A plurality of second air ducts 23 are formed between the second sidewall 202 and the guiding elements 21, between the second sidewall 202 and portions of the bending portions 2011 and between the second sidewall 202 and the third sidewall 203 and communicate with the first air ducts 22. Further, a plurality of first air vents 24 are formed at junctions of the bending portions 2011 and the guiding elements 21, and a plurality of second air vents 25 are formed at junctions of the guiding elements 21 and the third sidewall 203.

Figure 3:
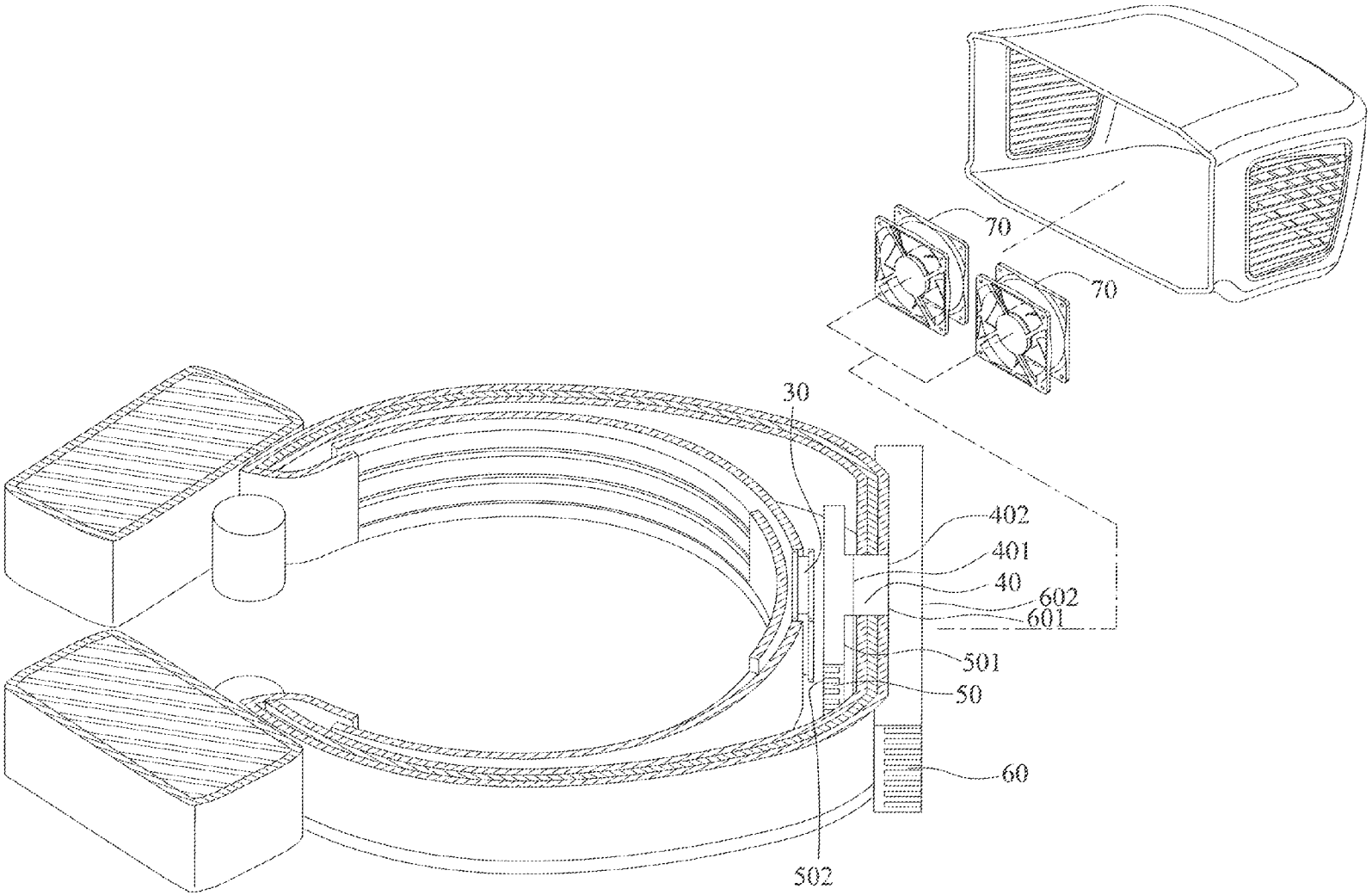
FIG. 3 is a schematic partially exploded view of the air-conditioning device of the present invention.

FIG. 3 is a schematic partially exploded view of the air-conditioning device of the present invention. Referring to FIG. 3, the air-conditioning device of the present invention further has a first aluminum sheet 50 having a first side surface 501 and a second side surface 502 opposite to the first side surface 501. The cooling chip 40 has a first surface 401 facing the first fan 30 and a second surface 402 opposite to the first surface 401. The first side surface 501 of the first aluminum sheet 50 contacts the first surface 401 of the cooling chip 40 and the second side surface 502 of the first aluminum sheet 50 faces the first fan 30. The first aluminum sheet 50 is used to conduct cooling or heating energy generated by the cooling chip 40 so as to expand the range of temperature regulating area and enhance the temperature regulating effect.

Figure 4:
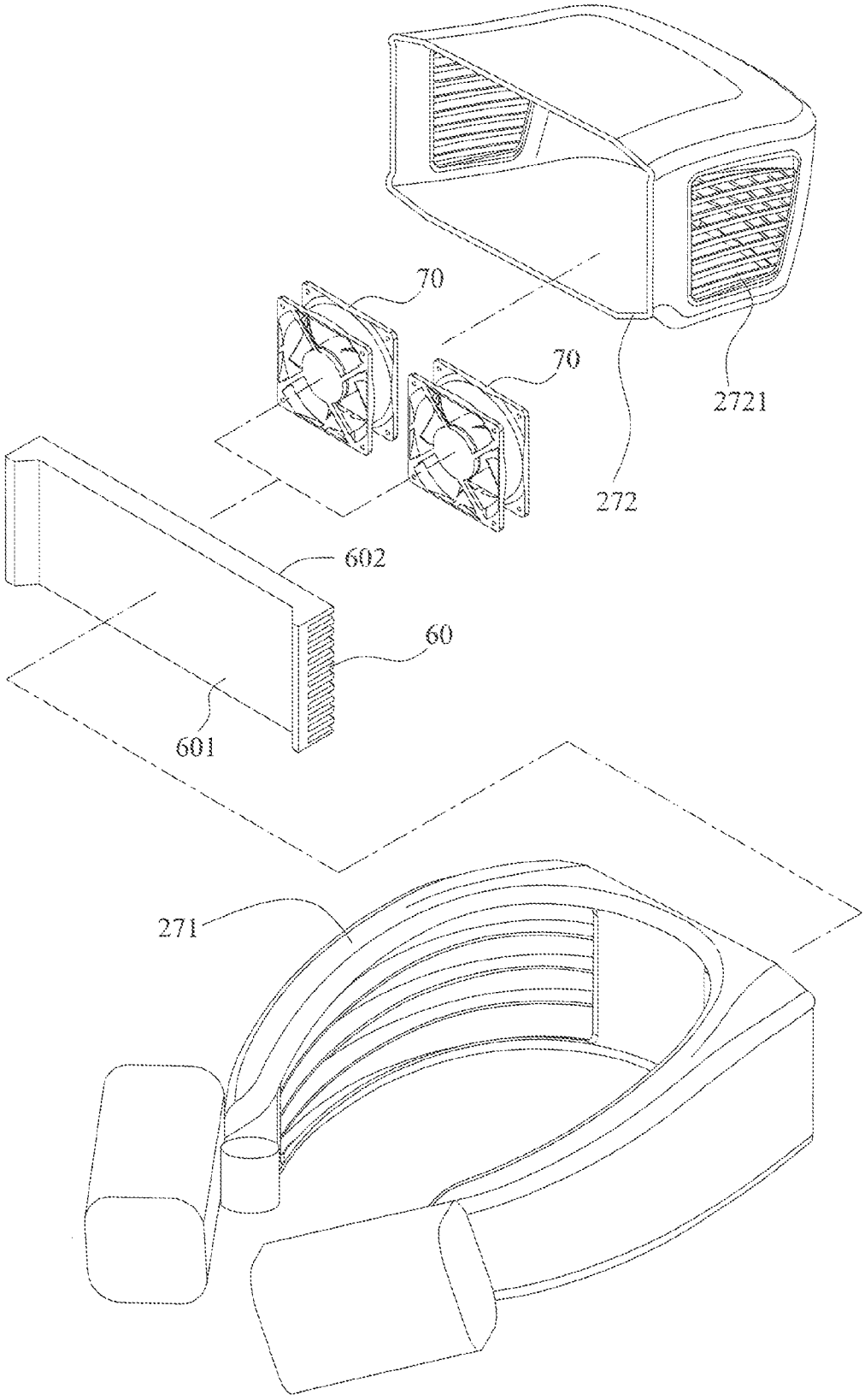
FIG. 4 is a schematic partially exploded view of the air-conditioning device of the present invention.

FIG. 4 is a schematic partially exploded view of the air-conditioning device of the present invention. Referring to FIGS. 3 and 4, the air-conditioning device of the present invention further has a second aluminum sheet 60 having a first side surface 601 contacting the second surface 402 of the cooling chip 40 and a second side surface 602 opposite to the first side surface 601. The second aluminum sheet 60 is also used to conduct cooling or heating energy generated by the cooling chip 40.

Further referring to FIG. 2, in an embodiment of the present invention, the air-conditioning device further has a heat insulating layer 26 at least partially enclosing the first sidewall 201 of the housing 20. The heat insulating layer 26 can be made of a material having light weight and high heat insulating efficiency, for example, PE foam. The heating insulating layer 26 is used to prevent the air circulating structure from being adversely affected by ambient temperature. In another embodiment, the heat insulating layer 26 and the first sidewall 201 are integrally formed. That is, both the heat insulating layer 26 and the first sidewall 201 constitute a portion of the housing 20.

Referring to FIGS. 2 and 4, the air-conditioning device of the present invention further has at least a second fan 70 disposed on the second side surface 602 of the second aluminum sheet 60. The second fan 70 can be used to accelerate discharge of waste cooling or heating energy so as to prevent it from accumulating in the device and adversely affecting the operating efficiency of the cooling chip 40.

Referring to FIGS. 2 and 4, the air-conditioning device of the present invention further has a cover 27 made of a material having a heat insulating effect. The cover 27 has a first cover portion 271 at least partially enclosing the housing 20 and the heat insulating layer 26 and a second cover portion 272 at least partially enclosing the second aluminum sheet 60 and the second fan 70, thereby protecting these enclosed components from being damaged. Further, the second cover portion 272 has a plurality of through holes 2721 for facilitating discharge of waste cooling or heating energy directed by the second fan 70 to the external environment. Referring to FIG. 4, the through holes 2721 can have a louver structure. In other embodiments, the through holes 2721 have a circular shape or other geometrical shape. In the present embodiment, a plurality of through holes 2721 having a louver structure are formed on three sides of the second cover portion 272.

Referring to FIG. 2, in another embodiment of the present invention, the air-conditioning device further has a power module 80 disposed on the cover 27. The power module 80 includes, for example, dry batteries or rechargeable batteries for providing power to the cooling chip 40, the first fan 30, the second fan 70 etc.

In the above-described embodiment, the power module 80 further has an operation interface unit 801 for controlling operation of the cooling chip 40, the first fan 30 and the second fan 70. For example, the power module 80 can control the cooling chip 40 to perform a cooling operation or a heating operation, or regulate the rotating speed of the first fan 30 and/or the second fan 70. Referring to FIGS. 2 and 3, in the present embodiment, the operation interface unit 801 is disposed on an upper surface of the housing of the power module 80. Alternatively, the operation interface unit 801 can be disposed on a side surface of the housing of the power module 80 or at any position where it is convenient for the user to operate the operation interface unit 801.

In an embodiment, the air-condition device of the present invention further has a pivot 90 disposed on the cover 27 for pivotally connecting the cover 27 and the power module 80. As such, the power module 80 is pivotal relative to the cover 27.

Figure 5:
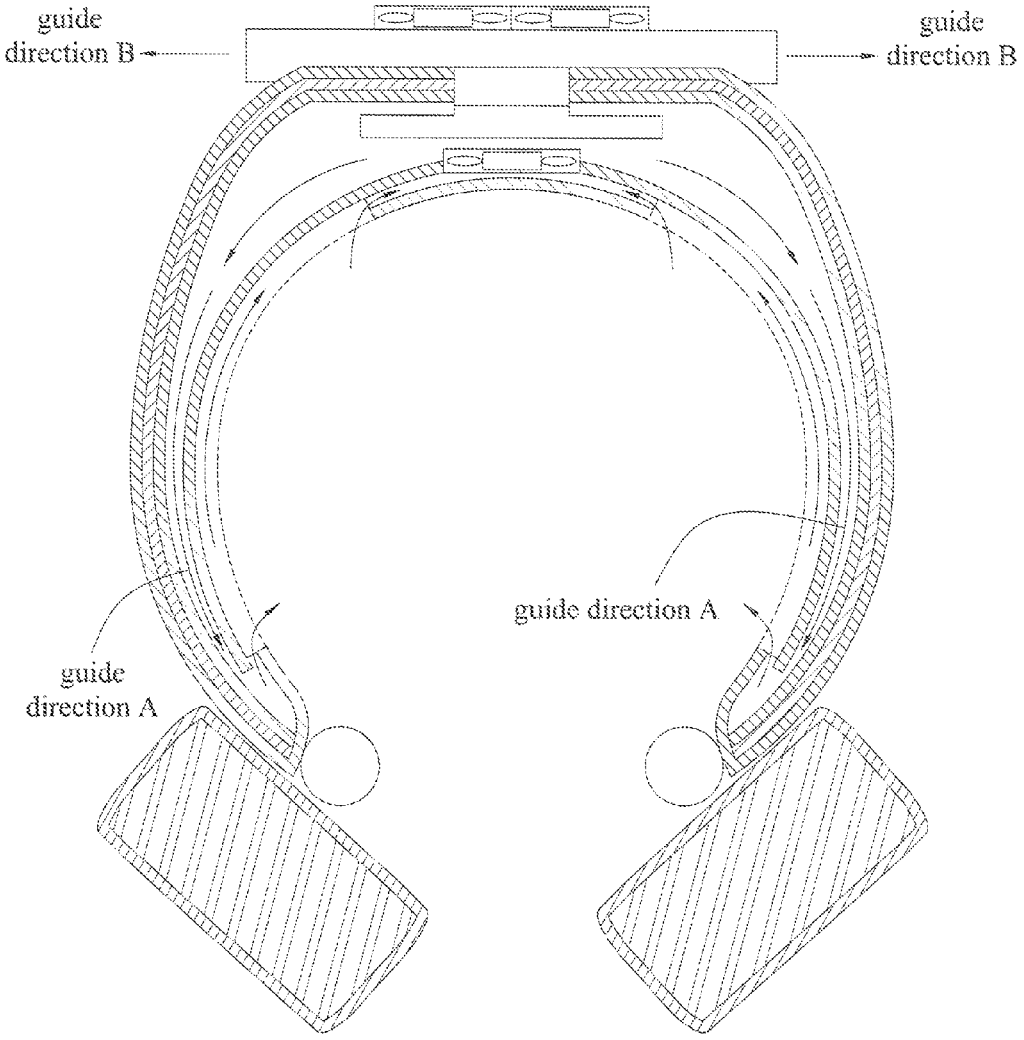
FIG. 5 is a schematic view showing flow guiding directions of the air-conditioning device in operation.

FIG. 5 is a schematic view showing flow guiding directions of the air-conditioning device in operation. Referring to FIGS. 2 and 5, operation of the first fan 30 causes heating or cooling energy of the cooling chip 40 to quickly form heating or cooling air flow that is guided to the first air ducts 22 and the second air ducts 23 and spreads to the receiving space enclosed by the housing 20 through the first air vents 24. Further, external air flow is guided by the guiding elements 21 into the second air vents 25 through the second air ducts 23 so as to form circulating air flow. In addition, the cooling chip 40 is a semiconductor chip that can freely perform cooling, heating and temperature control, and a temperature difference can be generated between the two sides of the chip through control of electric current. Referring to FIG. 5, when the user uses the air cooling function, the cooling chip 40 generates cooling energy on the first surface 401 thereof and the cooling energy flows in a guide direction A of FIG. 5. Further, the cooling chip 40 generates heating energy on the second surface 402 thereof and the heating energy flows to the external environment in a guide direction B of FIG. 5. Otherwise, when the user uses the air heating function, the cooling chip 40 generates heating energy on the first surface 401 thereof and the heating energy flows in the guide direction A of FIG. 5, and the cooling chip 40 generates cooling energy on the second surface 402 thereof and the cooling energy flows to the external environment in the guide direction B of FIG. 5.

According to the present invention, the design of the air ducts and air vents allows the temperature difference generated by the cooling chip to be spread in a wide range of area. When the user wears the air-conditioning device around the neck, the air-conditioning device can keep the head and neck region of the user cool or warm under different weather conditions, thereby reducing the possibility of discomfort of the user due to large variation in weather temperature. Since the air circulating structure allows recirculation and reuse of heating or cooling air that spreads out, over-operation of the cooling chip and the power module is reduced, thus reducing the risk of damage of the cooling chip and the power module caused by over-operation.

The above-described descriptions of the detailed embodiments are only to illustrate the preferred implementation according to the present invention, and it is not to limit the scope of the present invention. Accordingly, all modifications and variations completed by those with ordinary skill in the art should fall within the scope of present invention defined by the appended claims.

What is claimed is:

1. An air circulating structure, comprising:

a housing having a first sidewall constituting a peripheral portion of the housing and defining a receiving space and a second sidewall and a third sidewall positioned in the receiving space with the second sidewall positioned between the first sidewall and the third sidewall, wherein at least an opening is formed in the first sidewall and bending portions are formed at two ends of the first sidewall relative to the opening and bending inward; and a plurality of guiding elements disposed on sides of the second sidewall facing the receiving space and positioned between the third sidewall and the bending portions, wherein, a plurality of first air ducts are formed between the first sidewall and the second sidewall, a plurality of second air ducts are formed between the second sidewall and the guiding elements, between the second sidewall and portions of the bending portions and between the second sidewall and the third sidewall and communicate with the first air ducts, a plurality of first air vents are formed at junctions of the bending portions and the guiding elements, and a plurality of second air vents are formed at junctions of the guiding elements and the third sidewall.

2. The structure of claim 1, wherein ends of the second sidewall extend into areas enclosed by the bending portions.

3. The structure of claim 1, further comprising a heat insulating layer that at least partially encloses the housing.

4. The structure of claim 3, wherein the heat insulating layer and the first sidewall are integrally formed.

5. The structure of claim 3, further comprising a cover that at least partially encloses the housing and the heat insulating layer.

6. An air-conditioning device, comprising:

a housing having a first sidewall constituting a peripheral portion of the housing and defining a receiving space and a second sidewall and a third sidewall positioned in the receiving space with the second sidewall positioned between the first sidewall and the third sidewall, wherein at least an opening is formed in the first sidewall and bending portions are formed at two ends of the first sidewall relative to the opening and bending inward, and a first opening is formed in the first sidewall and a second opening corresponding to the first opening is formed in the second sidewall;

a plurality of guiding elements disposed on sides of the second sidewall facing the receiving space and positioned between the third sidewall and the bending portions, wherein, a plurality of first air ducts are formed between the first sidewall and the second sidewall, a plurality of second air ducts are formed between the second sidewall and the guiding elements, between the second sidewall and portions of the bending portions and between the second sidewall and the third sidewall and communicate with the first air ducts, a plurality of first air vents are formed at junctions of the bending portions and the guiding elements, and a plurality of second air vents are formed at junctions of the guiding elements and the third sidewall;

a first fan disposed in the second opening of the second sidewall; and a cooling chip disposed in the first opening of the first sidewall.

7. The device of claim 6, further comprising a first aluminum sheet having opposite first and second side surfaces, wherein the cooling chip has a first surface facing the first fan and a second surface opposite to the first surface, the first side surface of the first aluminum sheet contacting the first surface of the cooling chip and the second side surface of the first aluminum sheet facing the first fan.

8. The device of claim 7, further comprising a second aluminum sheet having a first side surface contacting the second surface of the cooling chip and a second side surface opposite to the first side surface.

9. The device of claim 6, further comprising a heat insulating layer that at least partially encloses the housing.

10. The device of claim 9, wherein the heat insulating layer and the first sidewall are integrally formed.

11. The device of claim 8, further comprising a second fan disposed on the second side surface of the second aluminum sheet.

12. The device of claim 11, further comprising a cover, the cover comprising:

a first cover portion at least partially enclosing the housing and the heat insulating layer, and a second cover portion at least partially enclosing the second aluminum sheet and the second fan, wherein the second cover portion has a plurality of through holes.

13. The device of claim 12, further comprising a power module disposed on the cover.

14. The device of claim 13, wherein the power module comprises an operation interface unit.

15. The device of claim 13, further comprising a pivot disposed on the cover for pivotally connecting the cover and the power module.

* * * * *